US009005711B2

(12) United States Patent
Riganti et al.

(10) Patent No.: US 9,005,711 B2
(45) Date of Patent: Apr. 14, 2015

(54) METHOD FOR FORMING A LUBRICATING FILM

(75) Inventors: Fabio Riganti, Carnago (IT); Vincent Pierre Meunier, Arese (IT); Valerio Carsetti, Arese (IT); Fabio Brunetta, Cornuda Treviso (IT); Andrea Brunetta, Treviso (IT)

(73) Assignee: Solvay Specialty Polymers Italy S.p.A., Bollate (Milan) (IT)

( * ) Notice: Subject to any disclaimer, the term of this patent is extended or adjusted under 35 U.S.C. 154(b) by 538 days.

(21) Appl. No.: 13/125,251

(22) PCT Filed: Oct. 23, 2009

(86) PCT No.: PCT/EP2009/063957

§ 371 (c)(1),
(2), (4) Date: Apr. 20, 2011

(87) PCT Pub. No.: WO2010/046464

PCT Pub. Date: Apr. 29, 2010

(65) Prior Publication Data

US 2011/0206853 A1 Aug. 25, 2011

(30) Foreign Application Priority Data

Oct. 24, 2008 (EP) ..... 08167557

(51) Int. Cl.
*B05D 5/00* (2006.01)
*B05D 3/00* (2006.01)
(Continued)

(52) U.S. Cl.
CPC ..... *C10M 107/38* (2013.01); *C10M 169/02* (2013.01); *C10M 171/06* (2013.01);
(Continued)

(58) Field of Classification Search
USPC ..... 427/358, 358.5, 355
See application file for complete search history.

(56) References Cited

U.S. PATENT DOCUMENTS 3,214,478 A 10/1965 Milian
3,242,218 A 3/1966 Miller
(Continued)

FOREIGN PATENT DOCUMENTS

CA 786877 A 6/1968
DE 19942534 A1 3/2001
(Continued)

OTHER PUBLICATIONS

Pharmacology/Toxicology Review, Center for Drug Evaluation and Research Application No. 21-084_FOMBLIN HC25, Jan. 28, 2000.*
(Continued)

*Primary Examiner* — Dah-Wei D Yuan
*Assistant Examiner* — Hai Yan Zhang
(74) *Attorney, Agent, or Firm* — Osha Liang LLP

(57) ABSTRACT

A method of forming a lubricating film on a surface, comprising applying to a surface a multiphasic composition comprising at least one (per)fluoropolyether (PFPE) lubricant, water and from 0.1 to 3% by weight of water of at least one thickening agent, said multiphasic composition having a viscosity, when measured at 21° C. at a shear rate of 1 $sec^{-1}$ of at least 10 Pa×sec so as to form a layer, and drying said layer to form a lubricating film. The Applicant has found that by the use of the multiphasic composition as above detailed it is advantageously possible to convey to surface to be lubricated the PFPE lubricant by using application techniques (doctor blade, metering rod, . . . ) as those suitable for solid-like greases, while the actual conveyed lubricant behaves in lubrication as an oil, avoiding the use of fluorinated solvents.

12 Claims, 1 Drawing Sheet

(51) Int. Cl.

| | |
|---|---|
| ***B05D 3/02*** | (2006.01) |
| ***B05D 3/12*** | (2006.01) |
| ***C10M 107/38*** | (2006.01) |
| ***C10M 169/02*** | (2006.01) |
| ***C10M 171/06*** | (2006.01) |
| ***C10M 173/02*** | (2006.01) |

(52) U.S. Cl.

CPC ..... *C10M173/02* (2013.01); *C10M 2201/1036* (2013.01); *C10M 2209/0813* (2013.01); *C10M 2209/1036* (2013.01); *C10M 2209/126* (2013.01); *C10M 2213/043* (2013.01); *C10M 2213/0606* (2013.01); *C10M 2217/0213* (2013.01); *C10N 2240/06* (2013.01); *C10N 2250/121* (2013.01)

(56) References Cited

U.S. PATENT DOCUMENTS

| | | | | |
|---|---|---|---|---|
| 3,665,041 | A | 5/1972 | Sianesi et al. | |
| 3,715,378 | A | 2/1973 | Belardinelli et al. | |
| 4,523,039 | A | 6/1985 | Lagow et al. | |
| 4,976,992 | A * | 12/1990 | Chino et al. | 427/131 |
| 4,990,283 | A | 2/1991 | Visca et al. | |
| 5,000,864 | A | 3/1991 | Strepparola et al. | |
| 5,093,023 | A | 3/1992 | Pantini et al. | |
| 5,149,564 | A | 9/1992 | Kato et al. | |
| 5,160,733 | A | 11/1992 | Berthiaume et al. | |
| 5,190,681 | A | 3/1993 | Strepparola et al. | |
| 5,211,861 | A | 5/1993 | Lafratta et al. | |
| 5,225,249 | A * | 7/1993 | Biresaw et al. | 427/353 |
| 5,304,334 | A * | 4/1994 | Lahanas et al. | 516/23 |
| 5,439,673 | A * | 8/1995 | Murray | 424/70.12 |
| 5,441,655 | A | 8/1995 | Odello et al. | |
| 5,562,911 | A * | 10/1996 | Brunetta et al. | 424/401 |
| 5,779,944 | A | 7/1998 | Kopolow | |
| 6,313,291 | B1 | 11/2001 | Carignano et al. | |
| 6,524,597 | B2 | 2/2003 | Kashimoto | |
| 6,541,019 | B2 | 4/2003 | Pantini | |
| 6,653,263 | B1 | 11/2003 | Kuepper et al. | |
| 6,653,393 | B2 | 11/2003 | Ishii et al. | |
| 7,081,440 | B2 | 7/2006 | Navarrini et al. | |
| 2001/0031709 | A1 * | 10/2001 | Lenti et al. | 508/182 |
| 2003/0196727 | A1 | 10/2003 | Maccone | |

FOREIGN PATENT DOCUMENTS

| | | | |
|---|---|---|---|
| EP | 0148482 | A2 | 7/1985 |
| EP | 0360503 | A1 | 3/1990 |
| EP | 0597115 | A1 | 5/1994 |
| EP | 1162220 | A1 | 12/2001 |
| EP | 1336614 | A1 | 8/2003 |
| GB | 1226566 | A | 3/1971 |
| JP | 59107428 | B | 6/1984 |
| WO | WO 8700538 | A1 | 1/1987 |
| WO | WO 2008000706 | A1 | 1/2008 |
| WO | WO 2008065163 | A1 | 6/2008 |

OTHER PUBLICATIONS 13125251-417735-EICSEARCH.*

Maccone P., et al—"New Additives for Fluorinated Lubricants", 70th NLGI Annual Meeting, Hilton Head Island, South Carolina, Oct. 25-29, 2003, paper # 318; 11 pgs.

* cited by examiner

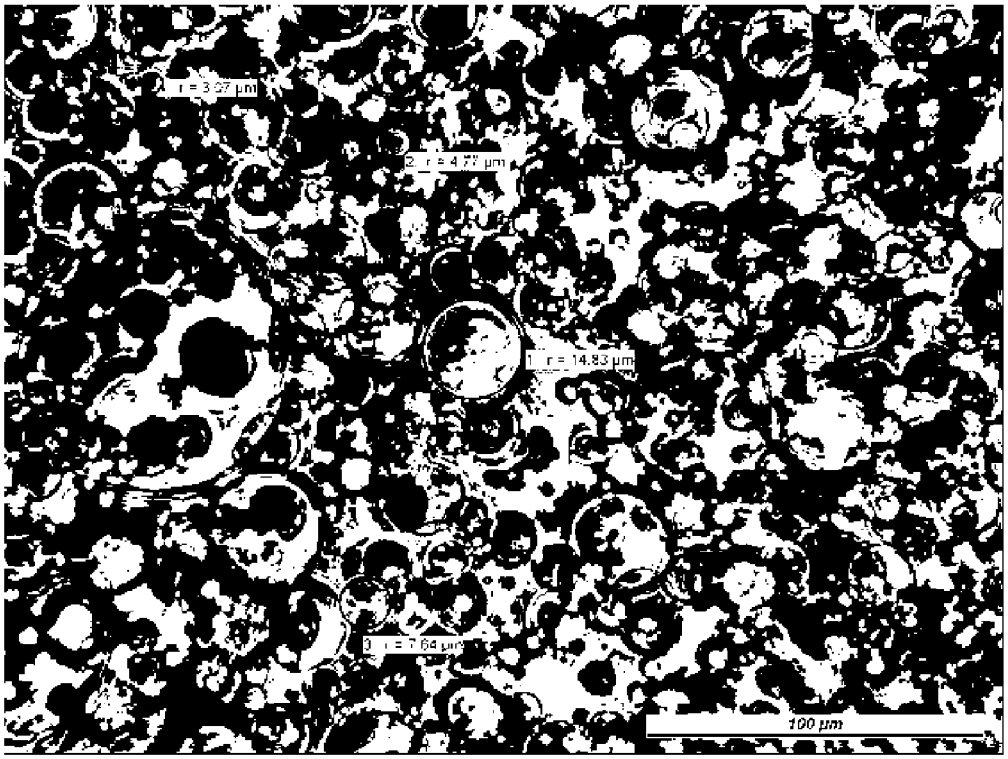
r = 3.97 µm
r = 4.77 µm
r = 14.83 µm
r = 7.64 µm
100 µm

METHOD FOR FORMING A LUBRICATING FILM

CROSS-REFERENCE TO RELATED APPLICATIONS

This application is a U.S. national stage entry under 35 U.S.C. §371 of International Application No. PCT/EP2009/063957 filed Oct. 23, 2009, which claims priority to European Application No. 08167557.1 filed Oct. 24, 2008, this application being herein incorporated by reference in its entirety for all purposes.

TECHNICAL FIELD

The present invention relates to a method of forming a lubricating film comprising a (per)fluoropolyether lubricant and a method of lubricating sliding parts.

BACKGROUND (Per)fluoropolyether (PFPE) lubricants are well-known engineered lubricants combining high-temperature performance, nonflammability, thermal and oxidative stability, and chemical inertness under a wide range of conditions.

For applying PFPE lubricants on sliding/moving parts, said lubricants can be applied as neat compounds. Nevertheless, kinematic viscosity of these fluids is such that their application on surface of difficult accessibility can be improper and/or their metering might be uneasy to control, so that uneven or inappropriate distribution of the lubricant is obtained.

Thus, in certain cases, to solve above mentioned issues, it has been suggested to dilute/suspend the same in suitable fluids so as to obtain a PFPE lubricant-containing composition having a substantially modified kinematic viscosity, so that different techniques, including dipping, spin coating, spraycoating, and the like, becomes suitable methods for conveying said PFPE lubricant to the surface to be lubricated.

Thus, JP 59107428 (SUWA SEIKOSHA KK) of Jun. 21, 1984 discloses a method of forming a lubricating film on a surface, wherein a perfluoropolyether lubricant is dissolved in a halogenoalkane solvent such as perfluoroalkane or chlorofluoroalkane, so obtained solution is then applied to the target surface by means of dipping, spin coating, spray coating or the like, final drying yielding the lubricating film. Nevertheless, in this method, use is made of fluorinated solvents like CFC 113, whose use has raised serious environmental concerns.

Certain low boiling point halogenated solvents have also been proposed for conveying PFPE lubricants; nevertheless, an appropriate recovery of the fluid during drying/evaporation is generally required, due to above mentioned environmental concerns.

Alternative solutions avoiding the use of such low boiling point halocompounds have been suggested; in particular, U.S. Pat. No. 5,149,564 (HITACHI LTD) of Sep. 22, 1992 teaches the use of water-borne emulsion comprising the PFPE lubricant and a suitable surfactant, preferably a polyoxyethylene alkylether surfactant for forming lubricating film on surfaces. Nevertheless, only very diluted emulsions possess suitable stability against phase separation for being actually used at industrial level, so that extensive drying is required, with consequent limitation of real applicability of this solution.

Aqueous based PFPE microemulsions such as those taught in U.S. Pat. No. 4,990,283 (AUSIMONT SPA (IT)) of Feb. 5, 1991 or in U.S. Pat. No. 5,211,861 (AUSIMONT S.R.L.) of May 18, 1993 might also provide an effective way of conveying the exceptional properties of PFPE lubricants to surfaces; nevertheless, these technologies requires use of fluorinated surfactants which might raise environmental concerns.

Nevertheless, none of the above detailed solution offers a reliable method for forming adequate lubricating films, in particular on vertical surfaces.

SUMMARY OF INVENTION

The Applicant has now surprisingly found that it is possible to efficiently convey (per)fluoropolyether lubricants on surfaces to be lubricated by formation of an appropriate water-borne multiphasic composition, having a gel-like behaviour, comprising the PFPE lubricants as below detailed.

It is thus an object of the invention a method of forming a lubricating film on a surface, said method comprising applying to a surface a multiphasic composition comprising at least one (per)fluoropolyether (PFPE) lubricant, water and from 0.1 to 3% by weight of water of at least one thickening agent, said multiphasic composition having a dynamic viscosity, when measured at 21° C. at a shear rate of 1 $sec^{-1}$, of at least 10 Pa×sec, so as to form a layer, and drying said layer to form a lubricating film.

The Applicant has found that by the use of the multiphasic composition as above detailed it is advantageously possible to convey to surface to be lubricated the PFPE lubricant by using application techniques (doctor blade, metering rod, brush . . . ) as those suitable for solid-like greases, while the actual conveyed lubricant behaves in lubrication as an oil, avoiding the use of fluorinated solvents.

The composition used in the process of the invention is multiphasic, that is to say that it comprises at least two separate phases.

Typically, the multiphasic composition of the invention comprises a continuous phase mainly comprising water and phase-separated domains mainly comprising PFPE lubricant.

BRIEF DESCRIPTION OF THE DRAWING

FIG. 1 shows a 400× magnification of a multiphasic composition manufactured according to the present invention.

DETAILED DESCRIPTION

The term "continuous phase mainly water" is intended to denote a continuous phase comprising water as major component, i.e. comprising more than 50%, preferably more than 60%, still more preferably more than 75% by weight of water.

The term "phase-separated domains mainly comprising PFPE lubricant" is intended to denote a phase-separated domain comprising PFPE lubricant as major component, i.e. comprising more than 50%, preferably more than 60%, still more preferably more than 75% by weight of PFPE lubricant.

The term "phase-separated domain" is intended to denote three-dimensional volume element of the composition, wherein the concentration of PFPE lubricant is at least 25% higher, preferably 30% higher, still more preferably 50% higher than the concentration of the PFPE lubricant in the continuous phase mainly comprising water.

At least 75% by volume of said phase-separated domains mainly comprising PFPE lubricant in the multiphasic composition have maximal dimension not exceeding 100 μm.

The term "maximal dimension" is intended to denote the maximal value of the diameter of a cross-sectional area, associated to each of the possible differently oriented cross-sections of the phase-separated domain.

A cross section is to be intended as the intersection of the phase-separated domain in three-dimensional space with a plane. From a practical point of view, when cutting into slices, many parallel cross sections are obtained.

The diameter of a cross-sectional area is defined as the diameter of the smallest circle which the cross-sectional area can be comprised in.

Maximal dimension of the phase-separated domains may be preferably determined by optical microscopy and image recognition on samples of the composition. Volume percent of phase-separated domains having maximal dimension not exceeding a relevant value is calculated by measuring surface area of such domains with respect to the total area of domains in the sample analysed by optical microscopy and image recognition.

It is generally preferred that at least 75% by volume of said phase-separated domains mainly comprising PFPE lubricant in the multiphasic composition have maximal dimension not exceeding 75 μm, preferably not exceeding 50 μm.

Best results have been obtained with multiphasic compositions wherein at least 75% by volume of said phase-separated domains have maximal dimension comprised between 10 and 40 μm.

The multiphasic composition of the invention has a dynamic viscosity, when measured at 21° C. at a shear rate of 1 $sec^{-1}$ of at least 10 Pa×sec, preferably of at least 20 Pa×sec, more preferably of at least 30 Pa×sec, still more preferably at least 40 Pa×sec.

In order to have an appropriate processability into a layer by standard methods, it is generally understood that the multiphasic composition used in the process of the invention will have a dynamic viscosity of at most 1000 Pa×sec, more preferably at most 500 Pa×sec.

Dynamic viscosity is advantageously determined according to ASTM D 4440 standard, following equations listed in Practice ASTM D 4065 to determine "Complex viscosity, $\eta^*$" at 1 rad×$sec^{-1}$ at a temperature of 21° C. in a cone and plate geometry (diameter=25 mm, angle=0.1 rad).

Above mentioned boundaries for viscosity of the multiphasic composition are those preferred for obtaining an efficient stabilisation of the dispersion of PFPE lubricants domain in the water continuous phase and still suitable processability for coating surfaces to be lubricated.

Methods for forming the multiphasic composition layer onto the surface to be lubricated are not limited; typically the composition will be applied by spreading on the surface using standard devices, according to well-known techniques like doctor blade coating, metering rod (or Meyer rod) coating, slot die coating, knife over roll coating or "gap coating", and the like.

Typically, drying the layer of multiphasic composition for obtaining the lubricating film is carried out at temperatures ranging advantageously from 20 to 100° C., preferably from 20 to 60° C.

The choice of this drying temperature is not critical; it is nevertheless understood that higher temperatures will advantageously provide shorter water evaporation times, thus quicker formation of the lubricating film.

Appropriate venting of air might be used for accelerating this evaporation; for instance, an air flux of about 50 to 500 Nl/h can be directed onto the surface to be lubricated for drying the layer, with advantageously no risk of disrupting the lubricating film.

The PFPE lubricant to be used in the present invention typically has a kinematic viscosity of advantageously 20 to 2000 cSt, preferably 30 to 1500 cSt, more preferably from 50 to 500 cSt, when determined at 20° C. according to ASTM D445.

The multiphasic composition as above detailed preferably comprises at least one PFPE lubricant selected from:

$$B—O—[CF(CF_3)CF_2O]_{b1'}(CFXO)_{b2'}—B' \quad (1)$$

wherein:

X is equal to —F or —$CF_3$;

B and B', equal to or different from each other, are selected from —$CF_3$, —$C_2F_5$ or —$C_3F_7$;

b1' and b2', equal to or different from each other, are independently integers ≥0 selected such that the b1'/b2' ratio is comprised between 20 and 1,000 and b1'+b2' is in the range 5 to 250; should b1' and b2' be both different from zero, the different recurring units are generally statistically distributed along the chain.

Said products can be obtained by photooxidation of the hexafluoropropylene as described in CA 786877 (MONTEDISON S.P.A.) of Jun. 4, 1968, and by subsequent conversion of the end groups as described in GB 1226566 (MONTECATINI EDISON S.P.A.) of Mar. 31, 1971.

$$C_3F_7O—[CF(CF_3)CF_2O]_{o'}-D \quad (2)$$

wherein

D is equal to —$C_2F_5$ or —$C_3F_7$;

o' is an integer from 5 to 250.

Said products can be prepared by ionic hexafluoropropylene epoxide oligomerization and subsequent treatment with fluorine as described in U.S. Pat. No. 3,242,218 (DU PONT) of Mar. 22, 1966.

$$\{C_3F_7O—[CF(CF_3)CF_2O]_{dd'}—CF(CF_3)—\}_2 \quad (3)$$

wherein dd' is an integer between 2 and 250.

Said products can be obtained by ionic telomerization of the hexafluoropropylene epoxide and subsequent photochemical dimerization as reported in U.S. Pat. No. 3,214,478 (DU PONT) of Oct. 26, 1965.

$$C'—O—[CF(CF_3)CF_2O]_{c1'}(C_2F_4O)_{c2'}(CFX)_{c3'}—C'' \quad (4)$$

wherein

X is equal to —F or —$CF_3$;

C' and C", equal to or different from each other, are selected from —$CF_3$, —$C_2F_5$ or —$C_3F_7$;

c1', c2' and c3' equal to or different from each other, are independently integers ≥0, such that and c1'+c2'+c3' is in the range 5 to 250; should at least two of c1', c2' and c3' be different from zero, the different recurring units are generally statistically distributed along the chain.

Said products can be manufactured by photooxidation of a mixture of $C_3F_6$ and $C_2F_4$ and subsequent treatment with fluorine as described in U.S. Pat. No. 3,665,041 (MONTEDISON S.P.A.) of May 23, 1972.

$$D-O—(C_2F_4O)_{d1'}(CF_2O)_{d2'}-D' \quad (5)$$

wherein

D and D', equal to or different from each other, are selected from —$CF_3$, —$C_2F_5$ or —$C_3F_7$;

d1' and d2' equal to or different from each other, are independently integers ≥0, such that the d1'/d2' ratio is comprised between 0.1 and 5 and d1'+d2' is in the range 5 to 250; should d1' and d2' be both different from zero, the different recurring units are generally statistically distributed along the chain.

Said products can be produced by photooxidation of $C_2F_4$ as reported in U.S. Pat. No. 3,715,378 (MONTEDISON S.P.A.) of Feb. 6, 1973 and subsequent treatment with fluorine as described in U.S. Pat. No. 3,665,041 (MONTEDISON S.P.A.) of May 23, 1972.

$$G\text{-}O\text{—}(CF_2CF_2C(Hal')_2O)_{g1'}\text{—}(CF_2CF_2CH_2O)_{g2'}\text{—}(CF_2CF_2CH(Hal')O)_{g3'}\text{-}G' \quad (6)$$

wherein

G and G', equal to or different from each other, are selected from —$CF_3$, —$C_2F_5$ or —$C_3F_7$;

Hal', equal or different at each occurrence, is a halogen chosen among F and Cl, preferably F;

g1', g2', and g'3 equal to or different from each other, are independently integers ≥0, such that g1"+g2'+g3' is in the range 5 to 250; should at least two of g1', g2' and g3' be different from zero, the different recurring units are generally statistically distributed along the chain.

Said products may be prepared by ring-opening polymerizing 2,2,3,3-tetrafluorooxethane in the presence of a polymerization initiator to give a polyether comprising repeating units of the formula: —$CH_2CF_2CF_2O$—, and optionally fluorinating and/or chlorinating said polyether, as detailed in EP 148482 A (DAIKIN INDUSTRIES) of Jul. 17, 1985.

$$L\text{-}O\text{—}(CF_2CF_2O)_{l'}\text{-}L' \quad (7)$$

wherein

L and L', equal to or different from each other, are selected from —$C_2F_5$ or —$C_3F_7$;

l' is an integer in the range 5 to 250.

Said products can be obtained by a method comprising fluorinating a polyethyleneoxide, e.g. with elemental fluorine, and optionally thermally fragmenting the so-obtained fluorinated polyethyleneoxide as reported in U.S. Pat. No. 4,523,039 (THE UNIVERSITY OF TEXAS) of Jun. 11, 1985; and $$R^1_f\text{—}\{C(CF_3)_2\text{—}O\text{—}[C(R^2_f)_2]_{kk1'}C(R^2_f)_2\text{—}O\}_{kk2'}\text{—}R^1_f \quad (8)$$

wherein $R^1_f$ is a perfluoroalkyl group having from 1 to 6 carbon atoms;

$R^2_f$ is equal to —F or perfluoroalkyl group having from 1 to 6 carbon atoms;

kk1' is an integer from 1 to 2;

kk2' represents a number in the range 5 to 250.

Said products can be produced by the copolymerization of hexafluoroacetone with an oxygen-containing cyclic comonomer selected from ethylene oxide, propylene oxide, epoxy-butane and/or trimethylene oxide (oxethane) or substituted derivatives thereof and subsequent perfluorination of the resulting copolymer, as detailed in patent application WO 87/00538 (LAGOW ET AL.) of Jan. 29, 1987;

$$T_l\text{-}O\text{—}[A\text{-}B]_z\text{-}[A\text{-}B']_{z'}\text{-}A\text{-}T_l'(I) \quad (9)$$

wherein;

A=—$(X)_a$—O-A'-$(X')_b$—, wherein A' is a (per)fluoropolyether chain; X, X', equal to or different from each other, are selected from —$CF_2$—, —$CF_2CF_2$—, —CF($CF_3$)—; a, b, equal to or different from each other, are integers equal to 0 or 1, with the proviso that the block A linked to the end group $T_l$-O— has a=1 and the block A linked to the end group $T'_l$ has b=0;

B is a segment of recurring units derived from one or more olefins having formula: —[($CR_1R_2$—$CR_3R_4$)$_j$($CR_5R_6$—$CR_7R_8$)$_{j'}$]—, wherein: j is an integer from 1 to 5, j' is an integer from 0 to 4 with the proviso that (j+j') is higher than 2 and lower than 10; $R_1$, $R_2$, $R_3$, $R_4$, $R_5$, $R_6$, $R_7$, $R_8$, equal to or different from each other, are selected from halogen (preferably F, Cl); H; $C_1$-$C_6$ groups, optionally containing F or other heteroatoms, preferably perfluoroalkyl or oxy(per)fluoroalkyl;

z is an integer higher than or equal to 2; z' is 0 or an integer; z, z' are such that the number average molecular weight of the polymer of formula (I) is in the range 500-500,000;

B' is a segment complying with formula (Ia), but having at least one of the substituents $R_1$ to $R_8$ different than in block B, (j+j') being higher than or equal to 2 and lower than 10;

$T_l$ and $T_l'$, equal to or different from each other, are selected from $C_{1-3}$ (per)fluoroalkyls, or $C_{1-3}$ alkyls.

Said products can be produced by reacting (per)fluoropolyethers comprising peroxide groups with (fluoro)olefins, as detailed in patent application WO 2008/065163 (SOLVAY SOLEXIS S.P.A.) of Jun. 5, 2008.

Non imitative examples of PFPE lubricants of the multiphasic composition suitable for the purposes of the invention are notably:

lubricants commercially available under the trade name FOMBLIN® (type Y, M, W, or Z) from Solvay Solexis, S.p.A.; lubricants of this family generally comprise at least one oil (i.e. only one or mixture of more than one oil) complying with either of formulae here below:

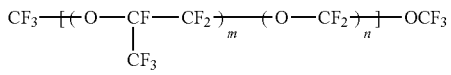

m + n = 8-45:m/n = 20-10 000

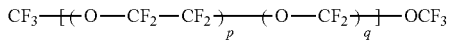

p + q = 40-180:p/q = 0.1-10 lubricants commercially available under the trade name KRYTOX® from Du Pont de Nemours, said lubricants generally comprising at least one (i.e. one or mixtures of more than one) low-molecular weight, fluorine end-capped, homopolymer of hexafluoropropylene epoxide with the following chemical structure:

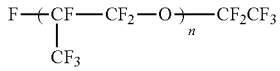

n = 10 to 60 lubricants commercially available under the trade name DEMNUM® from Daikin, said lubricants generally comprising at least one (i.e. one or mixture of more than one) oil complying with formula:

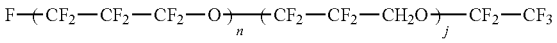

j = 0 or integer > 0; n + j = 10 to 150

More preferred PFPE lubricants are those commercially available under the trade name FOMBLIN®, as above detailed.

More specifically, most preferred PFPE lubricants are those complying with formula here below:

$$D^*\text{-}O\text{—}(C_2F_4O)_{d1^*}(CF_2O)_{d2^*}\text{-}D^{*'}$$

wherein

D* and D*', equal to or different from each other, are selected from —$CF_3$, —$C_2F_5$ or —$C_3F_7$;

d1* and d2* equal to or different from each other, are independently integers such that the d1'/d2' ratio is comprised between 0.1 and 5 and d1'+d2' is in the range 5 to 250; should d1' and d2' be both different from zero, the different recurring units are generally statistically distributed along the chain.

While the amount of PFPE lubricant in the multiphasic composition of the invention is not particularly limited, it is generally understood that the amount of the PFPE lubricant will range advantageously between 0.1 and 70% wt, preferably between 1 and 60% wt, more preferably between 5 and 50% wt, with respect to the sum of PFPE lubricant and water.

The term 'thickening agent' as used within the context of the present invention has its usual meaning and is intended to denote substances which, when added to an aqueous mixture, increase its viscosity without substantially modifying other properties.

Useful thickening agents can be selected from:

ion crosslinked organic polyacids, that is to say organic polyacids wherein ions are cross-linked by addition of a salt, so that molecular chains are extended to develop the thickening property;

minerals; examples of suitable minerals are notably clays, particularly bentonite and montmorillonite; colloidal alumina;

celluloses; typically used thickening celluloses are carboxymethyl celluloses, hydroxyethyl celluloses, hydroxypropyl celluloses;

high molecular weight polyethynene oxides and derivatives thereof (e.g. esters, like distearates);

polysaccarides and natural gums; typical examples of useful polysaccharides and natural gums are agaropectin, agarose, agar, carrageenan, pectin, chitosan, Beta-glucan, Carrageenan, Chicle gum, Dammar gum, Gellan gum, Glucomannan, Guar gum, Gum Arabic, Gum ghatti, Gum tragacanth, Karaya gum, Locust bean gum, Mastic gum, Psyllium seed husks, Spruce gum, Tara gum, Xanthan gum, Cyamoposis Gum, Vee gum, Welan gum, Ramthan gum, Gelan gum;

collagen derivatives; non limitative examples are gelatine and other partially hydrolized collagens;

acrylamide polymers; both homopolymers and copolymers of acrylamide can be used;

and mixtures thereof.

Among thickening agents, ion crosslinked organic polyacids are preferred.

Preferred ion crosslinked organic acids are notably polyaddition polymers comprising recurring units derived from ethylenically unsaturated monomers comprising an acid moiety, more preferably derived from (meth)acrylic acid, ethylene sulfonic acid, styrenesulfonic acid, 2-sulfoethyl methacrylate, 2-acrylamido-2-methylpropanesulfonic acid, or polycondensation polymers comprising recurring units derived from saccharides having acid moieties, more preferably derived from D-mannuronic acid, L-guluronic acid, hyaluronic acid, alginic acid.

More preferably, the ion crosslinked organic acids used is thickening agent is a (meth)acrylic acid polymer, most preferably an acrylic acid polymer.

Salts used in combination with the polyacids are not particularly limited; inorganic alkalis, such as sodium hydroxide, potassium hydroxide, sodium carbonate, and sodium hydrogen carbonate; divalent metallic salts such as calcium chloride and magnesium chloride; ammonia; and organic amines such as monoethanolamine, triethylamine, diisopropylamine, di(2-ethyl-hexyl)amine, aminomethylpropanol, tetrahydroxypropylenediamine.

The amount of thickening agent is generally adjusted so that to provide a multiphasic composition having required viscosity.

It is nevertheless generally understood that the amount of thickening agent will range from 0.1 to 3%, preferably from 0.1 to 1% wt, more preferably from 0.1 to 0.7% by weight of water. Best results have been obtained with amounts of thickening agent comprised from 0.3 to 0.7% by weight of water.

The multiphasic composition may optionally comprise in addition to water one or more water-miscible organic solvents; typically said solvents will be selected among aliphatic alcohols and polyols, like notably ethanol, isopropanol, ethylene glycol, and derivatives thereof.

Further, a variety of usually added additives can be used in the multiphasic composition of the process of the invention.

As non-limiting examples of additives which can be used in the multiphasic composition, mention can be made of anti-rust additives, anti-wear additives, heat stabilizers, UV markers, and the like.

Among additives mention can be notably made of:

antirust additives based on functional PFPE, said functional PFPE comprising one or more (per)fluoropolyether chain and having at least one end group selected from —CFX—CN; —CFX—$CH_2$—$NR_1R_2$, wherein $R_1$ and $R_2$, being hydrocarbon group optionally containing heteroatoms selected from O, N and S;

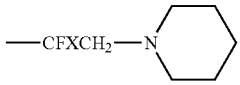

the radical X representing F or $CF_3$, examples of these additives are provided in U.S. Pat. No. 5,190,681 (AUSIMONT SRL (IT)) of Mar. 2, 1993;

antirust additives based on functional PFPE, said functional PFPE comprising one or more (per)fluoropolyether chain and a mixture of acidic COOH (optionally salified or converted into amidic group) end-groups and ketonic —C(O)$CF_3$ (optionally under hydrated —$C(OH)_2CF_3$ form) end-group; additives of this class are notably described in U.S. Pat. No. 5,000,864 (AUSIMONT SRL (IT)) of Mar. 19, 1991;

antiwear additives based on phosphazenes comprising (per)fluoropolyether chains; these additives are notably described in U.S. Pat. No. 5,441,655 (AUSIMONT SPA (IT)) of Aug. 15, 1995, EP 1336614 A (SOLVAY SOLEXIS S.P.A.) of Aug. 20, 2003, in MACCONE, P, et al. New additives for fluorinated lubricants. 70*th NLGI Annual Meeting, Hilton Head Island, S.C.* (Oct. 25-29, 2003). no. #318. or in WO 2008/000706 (SOLVAY SOLEXIS S.P.A.) of Jan. 3, 2008;

heat stabilizer additives based on functional PFPE comprising (per)fluoropolyether chain and triazine end groups; triazine-PFPE derivatives are notably described in U.S. Pat. No. 6,313,291 (AUSIMONT SPA (US)) of Nov. 6, 2001;

heat stabilizers based on functional PFPE comprising (per) fluoropolyether chain and aromatic end groups selected among optionally substituted phenoxy and nitro-aryl end groups, such as notably those described in U.S. Pat.

No. 7,081,440 (SOLVAY SOLEXIS S.P.A.) of Jul. 25, 2006 and in US 2003196727 (SOLVAY SOLEXIS SPA (US)) of Oct. 23, 2003;

antibacterial/preservative additives based on functional PFPE chain comprising (per)fluoropolyether chain and phosphate groups, such as notably those described in U.S. Pat. No. 6,541,019 (AUSIMONT S.P.A.) of Apr. 1, 2003.

The multiphase composition of the invention can be notably prepared by mixing the required ingredients in suitable mixing devices.

It is generally preferred in a first step to mix the PFPE lubricant and the water, and then, in a second step, adding the thickening agent.

In the first mixing step, apparatuses enabling achievement of high shear rate are preferred; typically, turbine stirrer, high intensity mixer and the like can be used.

High shear mixer emulsifiers can be used. For batches having size of less than 15 kg, those commercialized under trade name Silverson Heavy Duty Lab Mixer Emulsifier can be advantageously used.

Particularly suitable for the purposes of the invention are turboemulsifiers comprising a vessel equipped with a slow mixing system having a coaxial (counter-rotating) or planetary movement, a fast emulsifying group by means of a turbine, rotor and stator, positioned on the bottom of the vessel, and a vacuum circuit, such as those commercialized by Dumek.

These devices usually are operated with at least one mixing device operating at a revolution speed of at least 580 rpm, preferably at least 1400 rpm, more preferably at least 2700 rpm.

As a result, a mixture of finely dispersed PFPE lubricant droplets in water phase can be obtained. Typically, due to the non-miscibility of PFPE lubricant and water, this dispersion would not generally remain stable with time; the addition of the thickening agent enables advantageously 'freezing' these droplets in a quasi-solid dispersed form.

Thus, in a second step, the required addition of thickening agent is added until achievement of the target dynamic viscosity.

In case an ion crosslinked organic polyacid is used as a thickener, the polyacid precursor may be solubilized in water before mixing with the PFPE lubricant. The subsequent addition of the required salt of alkali can provide the required gellation and increase in dynamic viscosity.

In such a case, the pH of the multiphasic composition is typically adjusted between 3 and 10, preferably between 4 and 9. It has been observed that in case of ion crosslinked organic polyacid, above and below these pH values, the composition might not possess adequate viscosity and the stabilisation of the PFPE lubricant might fail.

Surfaces to be lubricated in the process of the invention are not particularly limited and can be notably plastic surfaces, metal surfaces, and inorganic oxide surfaces.

The process of the invention is particularly suitable for forming lubricating films on plastic and metal surfaces, in particular for lubricating plastic-plastic couples or plastic-metal couples.

Among plastic surfaces typically used in the process of the invention, mention can be made of surfaces of thermoplastic polymers, such as POM, PBT, PET, PC, ABS, PEX, PA, PMMA and the like, or of elastomers, such as EPDM, TPO, ETC; each of these surfaces might be lubricated for reducing attrition when coupled with another plastic surface, of identical or different plastic, or when coupled with a metal surface, e.g. a steel surface.

The invention will be now described with reference to the following examples, whose purpose is merely illustrative and not intended to limit the scope of the invention.

EXAMPLES

Raw Materials

PFPE-1 is a PFPE lubricant commercially available as FOMBLIN® M30 having following structure: $CF_3O—(C_2F_4O)_p—(CF_2O)_q—CF_3$, having a p/q ratio of about 0.75 to 1.1, an average molecular weight of about 9800 and a kinematic viscosity of about 159 cSt at 40° C.

Thickener-1 is CARBOPOL® Ultrez 21 acrylates/C10-C30 alkyl acrylate crosspolymer.

Additive-1 is a preservative additive based on functional PFPE having phosphate end groups, commercially available under the trade name FOMBLIN® HC/P2-1000.

General method for the manufacture of the multiphasic compositions

The required amount of lubricant, additive and water were mixed in a high shear mixer; Thickener was then added under vigorous stirring and aqueous NaOH solution was added to set the pH values between 5 and 8.

Composition of the multiphasic composition and dynamic viscosity [η] measured at 21° C. at a shear rate of 1 $sec^{-1}$ is summarized in the following table.

TABLE 1

| Run | 1 | 2 | 3 |
|---|---|---|---|
| PFPE-1 | 10% W/W | 20% W/W | 30% W/W |
| water | 87.3% W/W | 77.3% W/W | 67.3% W/W |
| Thickener-1 | 0.5% W/W | 0.5% W/W | 0.5% W/W |
| Additive-1 | 2% W/W | 2% W/W | 2% W/W |
| NaOH | 0.2% W/W | 0.2% W/W | 0.2% W/W<br>0.2% W/W |
| [η] | 46 Pa × sec | 47 Pa × sec | 50 pa × sec |

FIG. 1 shows a magnification (400×) of the composition of example 3.

The multiphasic compositions have been applied on different surfaces (PC and EPDM) using a rod coater forming a lubricating layer of around 10 micrometers after water evaporation.

Evaluation of lubricating properties has been carried out on the so lubricated surfaces according to ASTM D 1894-87. The lubricating properties of the so formed lubricating lay have been compared to those of the same lubricant applied using traditional application method (i.e. from solution with low boiler solvents, e.g. 3M Novec® fluid and Solvay Solexis Galden® HT55 fluid) and having the same lubricating film thickness. Whether the lubricant has been applied from multiphasic compositions or from a solution with low boiler the reduction of both static and dynamic friction coefficients has been achieved. More in particular, for PC static friction coefficient decreases from 0.19 for not lubricated surfaces to 0.15 for lubricated surfaces independently on application method (dynamic friction coefficient from 0.15 to 0.11).

Static friction coefficient for EPDM has been reduced from 1.90 for not lubricated surfaces to 0.68 for surfaces with lubricant applied from multiphasic compositions or from a solution with low boiler (dynamic friction coefficient from 1.31 to 0.28).

The invention claimed is:

1. A method of forming a lubricating film on a surface, said method comprising: applying to a surface a multiphasic composition comprising at least one (pre)fluoropolyether (PFPE) lubricant, water, and at least one thickening agent present at from 0.1% to 3% by weight of water, said multiphasic composition having a dynamic viscosity, when measured at 21° C. at a shear rate of 1 $sec^{-1}$, of at least 10 Pa×sec, so as to form a layer, wherein the multiphasic composition comprises a water continuous phase; and drying said layer to form a lubricating film.

2. The method of claim 1, wherein the multiphasic composition comprises a water continuous phase mainly comprising water and phase-separated domains mainly comprising PFPE lubricant, at least 75% by volume of said phase-separated domains have maximal dimension not exceeding 100 μm.

3. The method of claim 2, wherein the multiphasic composition has a viscosity of at least 20 Pa×sec.

4. The method of claim 1, wherein the PFPE lubricant is selected from the group consisting of:

$$B\text{-}O\text{-}[CF(CF_3)CF_2O]_{b1'}(CFXO)_{b2'}\text{-}B' \quad (1)$$

wherein:

X is equal to —F or —$CF_3$;

B and B', equal to or different from each other, are selected from the group consisting of —$CF_3$, —$C_2F_5$, and —$C_3F_7$;

b1' and b2', equal to or different from each other, are independently integers >0 selected such that the b1'/b2' ratio is comprised between 20 and 1,000, and b1'+b2' is in the range 5 to 250;

$$C_3F_7O\text{-}[CF(CF_3)CF_2O]_{o'}\text{-}D \quad (2)$$

wherein

D is equal to —$C_2F_5$ or —$C_3F_7$;

o' is an integer from 5 to 250.

$$\{C_3F_7O\text{-}[CF(CF_3)CF_2O]_{dd'}\text{-}CF(CF_3)\text{-}]\}_2 \quad (3)$$

wherein dd' is an integer between 2 and 250.

$$C'\text{-}O\text{-}[CF(CF_3)CF_2O]_{c1'}(C_2F_4O)_{c2'}(CFX)_{c3'}\text{-}C'' \quad (4)$$

wherein

X is equal to -F or —$CF_3$;

C' and C'', equal to or different from each other, are selected from the group consisting of —$CF_3$, —$C_2F_5$ and —$C_3F_7$;

c1', c2' and c3' equal to or different from each other, are independently integers ≥0, such that and c1'+c2+c3' is in the range 5 to 250;

$$D\text{-}O\text{-}(C_2F_4O)_{d1'}(CF_2O)_{d2'}\text{-}D' \quad (5)$$

wherein

D and D', equal to or different from each other, are selected from the group consisting of —$CF_3$, —$C_2F_5$ and —$C_3F_7$;

d1' and d2' equal to or different from each other, are independently integers ≥0, such that the d1'/d2' ratio is comprised between 0, 1 and 5 and d1'+d2' is in the range 5 to 250;

$$G\text{-}O\text{-}(CF_2CF_2C(Hal')_2O)_{g1'}\text{-}(CF_2CF_2CH_2O)_{g2'}\text{-}(CF_2CF_2CH(Har)O)_{g3'}\text{-}G' \quad (6)$$

wherein

G and G', equal to or different from each other, are selected from the group consisting of —$CF_3$, —$C_2F_5$ and —$C_3F_7$;

Hal', equal to or different at each occurrence, is a halogen selected from the group consisting of F and Cl;

g1', g2', and g'3 equal to or different from each other, are independently integers ≥0, such that g1'+g2'+g3' is in the range 5 to 250;

$$L\text{-}O\text{-}(CF_2CF_2O)_{l'}L' \quad (7)$$

wherein

L and L', equal to or different from each other, are selected from the group consisting of —$C_2F_5$ and —$C_3F_7$;

l' is an integer in the range 5 to 250;

$$R^1_f\text{-}\{C(CF_3)_2\text{-}O\text{-}[C(R^2_f)_2]_{kk1'}C(R^2_f)_2\text{-}O\}_{kk2'}\text{-}R^1_f \quad (8)$$

wherein $R^1_f$ is a perfluoroalkyl group having from 1 to 6 carbon atoms;

$R^2_f$ is equal to —F or perfluoroalkyl group having from 1 to 6 carbon atoms;

kk1' is an integer from 1 to 2;

kk2' represents a number in the range 5 to 250; and $$T_1\text{-}O\text{-}[A\text{-}B]z\text{-}[A\text{-}B']z\text{-}A\text{-}T_1' \text{ (I)} \quad (9)$$

wherein:

$A=(x)_a$—O—A'—A-$(X')_b$—, wherein A' is a (per)fluoropolyether chain; X, X', equal to or different from each other, are selected from the group consisting of —$CF_2$—, —$CF_2CF_2$—, and —$CF(CF_3)$—; a, b, equal to or different from each other, are integers equal to 0 or 1, with the proviso that the block A linked to the end group $T_1O$— has a =1 and the block A linked to the end group $T'_1$ has b=0;

B is a segment of recurring units derived from one or more olefins having formula: -[$(CR_1R_2$—$CR_3R_4)_j(CR_5R_6$—$CR_7R_8)_{j'}$]—, wherein: j is an integer from 1 to 5, j' is an integer from 0 to 4 with the proviso that $(j+j^1)$ is higher than 2 and lower than 10; $R_1$, $R_2$, $R_3$, $R_4$, $R_5$, $R_6$, $R_7$, $R_8$, equal to or different from each other, are selected from the group consisting of halogen; H; $C_1$-$C_6$ groups, optionally containing F or other heteroatoms;

z is an integer higher than or equal to 2; z' is 0 or an integer; z, z' are such that the number average molecular weight of the polymer of formula (I) is in the range 500-500,000;

B' is a segment complying with formula (Ia), but having at least one of the substituents $R_1$ to $R_8$ different than in block B, $(j+j^1)$ being higher than or equal to 2 and lower than 10;

$T_1$ and $T_1'$, equal to or different from each other, are selected from the group consisting of $C_{1-3}$ (per)fluoroalkyls, and $C_{1-3}$ alkyls.

5. The method of claim 4, wherein the amount of the PFPE lubricant ranges between 0.1 and 70% wt, with respect to the sum of PFPE lubricant and water.

6. The method of claim 1, wherein the thickening agent is selected from the group consisting of:

ion crosslinked organic polyacids, wherein ions are crosslinked by addition of a salt, so that molecular chains are extended to develop the thickening property;

minerals;

celluloses;

high molecular weight polyethynene oxides and derivatives thereof;

polysaccarides and natural gums;

collagen derivatives;

acrylamide polymers;

and mixtures thereof.

7. The method of claim 6, wherein the thickening agent is an ion crosslinked organic acid selected from the group consisting of polyaddition polymers comprising recurring units derived from ethylenically unsaturated monomers comprising an acid moiety, and polycondensation polymers comprising recurring units derived from saccharides having acid moieties.

8. The method of claim 7, wherein the thickening agent is a (meth)acrylic acid polymer.

9. The method of claim 1, wherein the layer of multiphasic composition is formed spreading on the surface using standard devices, according to techniques selected from the group consisting of doctor blade coating, metering rod coating, slot die coating, knife over roll coating, and "gap coating".

10. The method of claim 1, wherein the multiphasic composition is prepared by mixing the required ingredients in suitable mixing devices, wherein, in a first step the PFPE lubricant and the water are mixed, and then, in a second step, the thickening agent is added.

11. The method of claim 1, wherein drying the layer of multiphasic composition for obtaining the lubricating film is effected at temperatures ranging from 20 to 100° C.

12. The method of claim 1, wherein the multiphasic composition comprises more than 60% of water by weight.

* * * * *